US006568834B1

(12) United States Patent
Scianna

(10) Patent No.: US 6,568,834 B1
(45) Date of Patent: May 27, 2003

(54) OMNIDIRECTIONAL LIGHTING DEVICE

(75) Inventor: Carlo Scianna, Des Plaines, IL (US)

(73) Assignee: Goeken Group Corp., Naperville, IL (US)

( * ) Notice: Subject to any disclaimer, the term of this patent is extended or adjusted under 35 U.S.C. 154(b) by 0 days.

(21) Appl. No.: 09/623,659

(22) PCT Filed: Mar. 4, 1999

(86) PCT No.: PCT/US99/04927

§ 371 (c)(1),
(2), (4) Date: Dec. 1, 2000

(87) PCT Pub. No.: WO99/45312

PCT Pub. Date: Sep. 10, 1999

Related U.S. Application Data

(60) Provisional application No. PCT/US99/04927, filed on Mar. 4, 1999.

(51) Int. Cl.[7] ..... F21V 14/00

(52) U.S. Cl. ..... 362/255; 362/311; 362/351; 362/362; 362/800; 313/636

(58) Field of Search ..... 362/582, 189, 362/255, 256, 362, 351, 293, 311, 800; 524/921; 313/636

(56) References Cited

U.S. PATENT DOCUMENTS

| | | | | | |
|---|---|---|---|---|---|
| 3,602,759 | A | * | 8/1971 | Evans | 313/112 |
| 4,822,855 | A | * | 4/1989 | Kobayashi et al. | 525/194 |
| 5,143,443 | A | | 9/1992 | Madsen | |
| 5,463,502 | A | | 10/1995 | Savage, Jr. | |
| 5,655,830 | A | * | 8/1997 | Ruskouski | 362/800 |
| 5,879,076 | A | * | 3/1999 | Cross | 362/555 |

* cited by examiner

*Primary Examiner*—Stephen Husar
(74) *Attorney, Agent, or Firm*—Barnes & Thornburg

(57) ABSTRACT

A light modifying material composed of ethylene/butene-1 copolymer or propylene homopolymer or a combination of the two, and lighting devices using the material in a light transmitting cover (20). It is preferred that the light source (10) for the devices is a semiconductor or light emitting diode (LED), to produce an energy efficient light source.

16 Claims, 2 Drawing Sheets

OMNIDIRECTIONAL LIGHTING DEVICE

The Applicant claims priority based on U.S. Provisional Patent Application Ser. No. 60/076,840 filed Mar. 4, 1998. This application incorporates co-pending and co-owned U.S. patent application Ser. No. 08/802,526, now U.S. Pat. No. 5,879,076, in its entirety.

BACKGROUND OF THE INVENTION

The present invention relates broadly to light transmission media and to associated lighting devices and improvements in lighting devices incorporating light emitting diodes as light sources, particularly the use of an ethylene/butene-1 copolymer or a propylene homopolymer to serve as a modifier to deliver a more uniform light output across the lighting device which allows the light to be diffused and magnified.

Light emitting diodes (LEDs) have been used for many purposes for many years. Generally they have been used as indicator lights and in arrays to form information displays. The light emitting diodes have the advantages of operating at a low voltage, approximately three volts, and energy efficiency, generating approximately 25 lumens of light per watt. The disadvantage of this type of lighting is that the light is unidirectional, that is, the light is directed only in the direction of the axis of the light emitting diode. The light does not diffuse to the sides. Typical LEDs provide light less than 40° from the axis of the diode. If the LED is being used in a warning light to alert the public to a danger, a person approaching the warning light from the side will not have their attention drawn to the peril.

The light from an LED is also concentrated, appearing to emanate from a small point. Currently many warning and signal lights constructed with LEDs do not meet specifications set by the Institute of Transportation Engineers. This is because the LEDs emit a highly concentrated intense unidirectional light causing a "hot" spot in the center of the signal face and the testing standard measures the light intensity over an area +/−10° from the optical center. In some cases an array of LEDs is used to provide a larger signal area, but such arrays are wasteful as they require more LEDs, increasing production costs and requiring more energy to operate.

Presently, incandescent light sources are widely used in existing lighting devices. Examples of these products are exit lights, flashing yellow barrier lights, lighted exit signs required in buildings, Christmas lights, hand held signal lights such as those used by traffic police, and instrument panel display lights. Because these devices use incandescent light bulbs, they are inefficient. They are also susceptible to vibration, which may cause a failure or a shortening of the bulbs useful life. The mean time between failure for a typical incandescent device is less than 5000 hours. A typical LED has a mean time between failure of 100,000 hours.

The following table summarizes the comparison of current designs using various light sources:

It is an object of this invention to provide a reduced power light source for warning devices, signs, and other illuminated articles. It is also an object of this invention to provide an omnidirectional LED light source and a device that gives a more uniform light output across the face of the device compared to the unidirectional concentrated light of traditional LED light devices.

This invention need not be restricted to LEDs as the light source. It can also utilize any light source, both visible and invisible such as infra-red, such as an incandescent, flourescent, or neon bulb, or lasers.

DISCLOSURE OF THE INVENTION

The device of this invention is an omni-directional light assembly that emits light from the side as well as in the direction of the axis of the light source. The light is dispersed and magnified by a light transmitting material herein disclosed so that persons approaching such a device from the side would clearly see the emitted light. More particularly, the invention is directed towards an omni-directional light assembly utilizing a non omni-directional light source, such as an LED.

The invention, when utilizing LEDs or other semiconductors, further provides the benefit of reduced power consumption over incandescent bulbs. The invention may further gain energy efficiency by utilizing solid state circuitry to pulse at a rate sufficiently high so as to appear to be steadily on, or in the alternative, pulse with and desired rate to create a flashing light. Such a circuit is disclosed in co-owned U.S. patent application Ser. No. 08/802,526 , now U.S. Pat. No. 5,879,076.

The invention has application in areas such as traffic safety barriers, logos or emblems, hand held light signals, exit or other warning and signal lights, safety articles as disclosed in U.S. patent application Ser. No. 08/802,526, now U.S. Pat. No. 5,879,076, as well as instrumentations lighting.

The apparatus of the present invention comprises the LED itself with a cover made of a plastic material such as ethylene or propylene. The cover can be clear or it can contain color. It may also be translucent or opaque, depending upon the formulation and method of production. Since the normal LED is small, a cover having a diameter in the range of about 3 inches would be satisfactory to cover the emitted light from the LED and provide the omni-directional condition for a warning light. The specific dimension of any article will vary with the application. It should be obvious that the cover can be made to any shape and size. As the size increases one may desire to use multiple LEDs.

The spatial relationship of the cover and the light source may vary. The cover may be spaced from the light source, as is the common design of typical incandescent lights and associated lenses. Alternatively, the light source can be placed against or in contact with the cover. An extension of this design is embedding the light source in the cover material. The LED light source lends itself well to this arrangement since it is small and gives off negligible heat.

The cover is made from a plastic material, preferably from a polyolefin and more preferably a polyolefin in either a rigid or semi-rigid state. The polyolefin is mixed with a hydrocarbon material to create a matte look. Broad ranges of hydrocarbons can be used for this purpose. A clarifying agent may also be added. An example of such an agent is Millad 3988 made by Milliken Chemical Company which is added at about 0.25% by weight of the polyolefin material. The cover is generally molded or blow molded from the polyolefin material in a conventional manner using heat or it may be extruded.

A particular polyolefin material which has been found useful in the invention is a propylene homopolymer designed for injection molding applications. This particular propylene homopolymer has a melt flow rate of 32 grams per 10 minutes, a density of 0.90 grams per $cm^3$, a melting point of 147° C., a tensile strength of 5.0 kpsi, an elongation of 16% and a flexural modulus of 200 kpsi. Such a compound is manufactured and sold by Exxon Chemical under the trademark ACHIEVE 1625.

A particular ethylene/butene-1 copolymer material which has been found useful in the invention is a copolymer designed for injection molding applications. Such a compound is manufactured and sold by Exxon Chemical under the trademark EXACT 4049.

The EXACT 4049 material is flexible and milky in color. The flexablility allows the lighting device made from the material to be easily bent or shaped into desired configurations. The ACHIEVE material is rigid and also milky in color. The ACHIEVE material is appropirate for applications where a rigid cover is desired. The two materials are compatible and may be mixed in any combination to result in a cover of desired rigidity or flexablility.

The ACHIEVE material is normally milky in color and transparent. The addition of a material known as Millad Concentrate 8C41-10, manufactured by Milliken chemical of Inman S.C. and belonging to the chemical family of sorbitol acetal in polyolefin blend, is known to act as a clarifying agent if added in a ratio of 25% by weight of the polyolefin material. One skilled in the art will readily recognize that other clarifying agents may be used.

The EXACT 4049 material may also be rendered clear by rapidly chilling the product immediately upon extrusion or molding. When the material is extruded or molded, it is typically at a temperature of 140° to 200° F. If allowed to cool at room temperature, the material will have a milky but translucent appearance. If the material is rapidly cooled however, the resulting product will be clear. The preferred way to cool the material is to bathe the product in chilled water just after it is extruded or molded and is still above 140° F. While there are many ways to accomplish the cooling, the preferred way is to spray chilled water upon the product. The water should be at a temperature just above freezing for the best results.

The cover described in this application is useable with numerous different kinds of LEDs. When the LED itself is not circular in its upper dimension the cover of this invention can be molded in different forms so that it is useful with any kind of an LED.

The cover may be shaped or molded into any number of desired shapes. Also, the LED may be placed anywhere within or at the surface of the cover. More than one LED may be used as a light source if the face of the device is large or if higher intensity light is desired.

The lights source and cover combination has many uses. For instance, the cover may be used with an incandescent bulb and suitable power source to from a signal or warning light, such as those commonly seen in highway construction zones. While the cover of the present invention would perform well with an incandescent light source, it would be preferable to utilize a light source of lower power consumption and longer life, such as an LED. LEDs have not been used in the past for barrier warning lights because of the unidirectional and concentrated nature of the light emitted. The cover modifies the concentrated light of the LED and spreads it out across the surface of the cover, resulting in an omnidirectional uniform lighting effect. Thus the cover allows use of an LED or an array of LEDs where incandescent lights were the preferred source. Suitable electronic circuitry may be electrically connected to the light source and power source to cause the light to flash at a desired time interval. Such circuits are well known to those skilled in the art.

The cover and LEDs and can be combined with a standard incandescent bulb base to create a replacement bulb for the incandescent bulb. Such a replacement bulb utilizing LEDs as a light source instead of a filament can provide a operational cost advantage.

BEST MODES OF CARRYING OUT THE INVENTION

Figure 1:
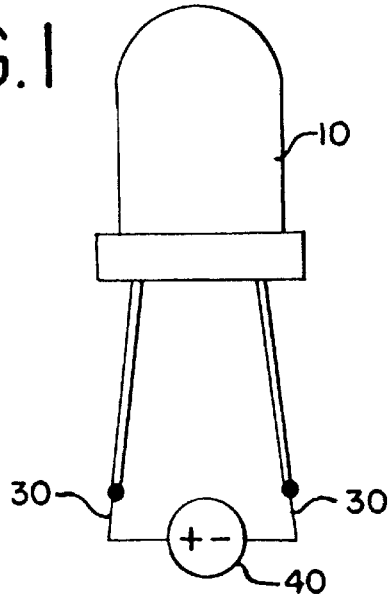
FIG. 1 is a side elevational view of a typical LED which may be used in connection with the cover of this invention.
Figure 2:
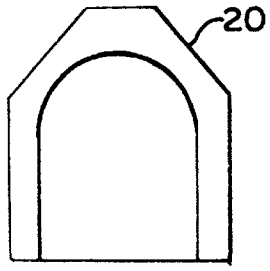
FIG. 2 is a sectional view of the cover of this invention which is designed to fit over the LED shown in FIG. 1. The cover is made of the plastic material already described and will when light is emitted from the LED, disperse and magnify the light.

Referring to FIGS. 1 and 2, the invention in its basic form includes a light source, such as an LED 10, and a cover 20. The LED 10 may be of any type depending upon the application. For applications requiring the most visibility, a high intensity LED may be selected For applications requiring a low power consumption, an LED of low power can be selected As is obvious to one skilled in the art, the LED 10 is electrically connected to a power source 40 by the conductors 30. In the preferred embodiment, the conductors 30 are length of wire, but could easily be any other suitable electrically conductive material.

The cover 20 is constructed of a substantially transparent polyolefin material. In the preferred embodiment, the cover 20 can be constructed of a material known as EXACT 4049, a material known as Acheive 1625, or a combination the two. The cover 20 may be of any color desired. Exact 4049 and Acheive 1625 materials are normally milky in color, but can be rendered clear by the methods described in this application.

Figure 3:
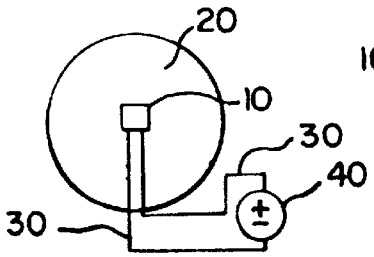
FIG. 3 is front view of a traffic barrier warning light utilizing a single LED light source embedded in a cover of light modifying plastic.

The preferred construction for a warning light is shown in FIG. 3. The LED 10 is placed generally in the center of the cover 20. The conductors 30 and the LED 10 are embedded in the cover 20 material. It is obvious to one skilled in the art how to connect the conductors to an appropriate power source for powering the LED 10. While it is preferred that the LED 10 be embedded in the cover 20, it is not necessary for the functioning of the invention. The LED 10 may be located at a surface of the cover 20, or located remotely from the surface. For instance, the cover 20 shown in FIG. 3 could be hollow, as would be the case if the cover 20 were produced by means of blow molding, thus defining a plenum in which the LED 10 could reside.

Figure 4:
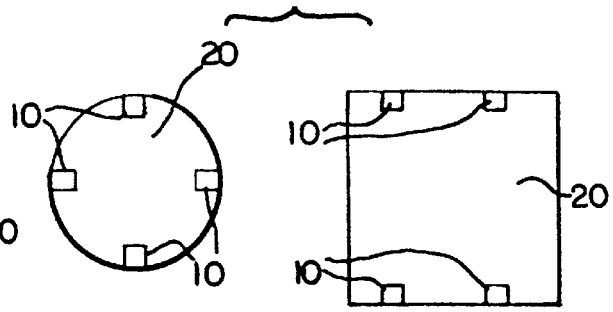
FIG. 4 is a front view of a generic signal light utilizing a plurality of LED light sources embedded in the cover of light modifying plastic.

As shown in FIG. 4, multiple LEDs 10 may be used in constructing the lighting device. The plurality of LEDs 10 can be located anywhere within the cover 20 depending upon the lighting effect desired. As disclosed above, it is not necessary that the LEDs 10 be embedded in the cover 20. Location is a choice dependant upon the design, use, and desired effect of the lighting device. For instance, for illumination of an exit sign constructed of the polyolefin materials disclosed, it may be desirable to locate the LEDs 10 at the perimeter of the cover. It is also obvious to one skilled in the art how to use the conductors 30 to electrically connect the LEDs 10 to one another and to a power source or other electronic circuitry.

Figure 5:
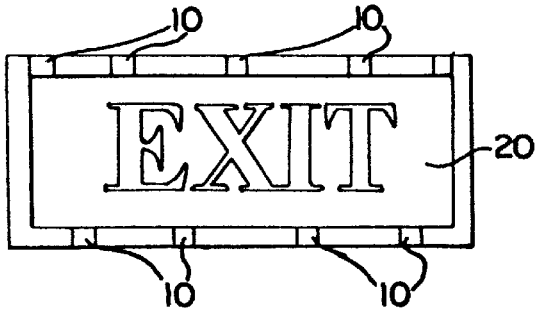
FIG. 5 is a front view of any exit sign utilizing a plurality of LED light sources positioned at the edge of the light modifying plastic.

The preferred construction of an exit sign is shown in FIG. 5. The cover 20 is generally rectangular in shape and approximately 8 inches by 14 inches by ¾ inches, but the dimensions can vary. The word "EXIT" can be formed on the cover by paint or other means commonly used in the art. A plurality of LEDs 10 are placed at the surface of the perimeter of the cover 20, although they may also be embedded in the cover material. Electrically connecting the LEDs to a power source is obvious to one skilled in the art.

Figure 6:
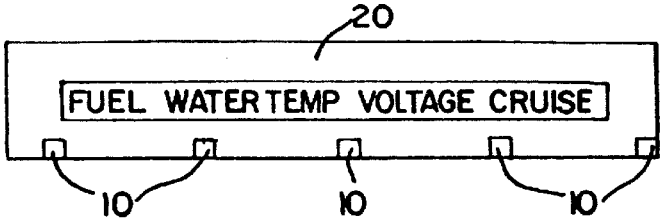
FIG. 6 is a front view of an instrument panel utilizing plurality of LED light sources positioned within the cover of light modifying plastic.

FIG. 6 shows an example of automobile instrument panel indicators constructed using the light transmitting material disclosed herein. The cover 20 is used to transmit the light from the LEDs 10 to the mask carrying the indicia of the instrument panel so that the message of the indicia can be observed by the operator.

Figure 7:
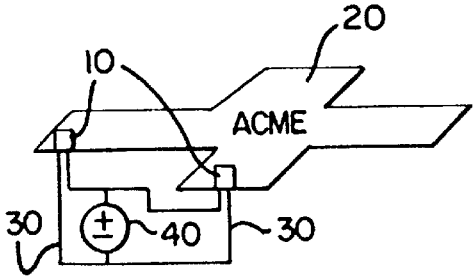
FIG. 7 is a perspective view of lighted logo or emblem design utilizing a plurality of Led light sources.

FIG. 7 shows an example of a lighted emblem or logo to be attached to an article of clothing. The cover 20 will generally be as thin as 1/16 inches and 3 inches diameter, but dimensions will vary with the design. The emblem may employ a single or multiple LEDs 10, which need not he the same. The LEDs 10 are placed in contact or embedded in the cover 20 material. The cover 20 may bare an indicia of source, such as ACME in the example. The power source 40 is preferable a small button cell battery so as not to add bulk.

Figure 8:
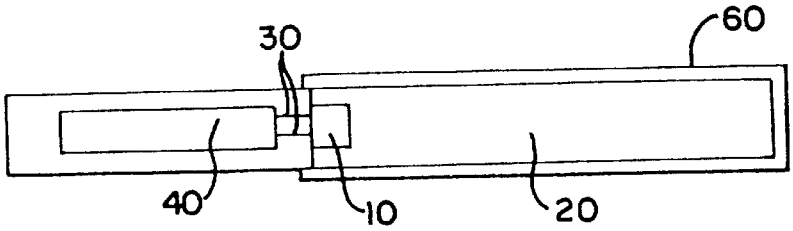
FIG. 8 is a side view of a hand held light signal utilizing an LED embedded in a light modifying plastic cover.
Figure 8A:
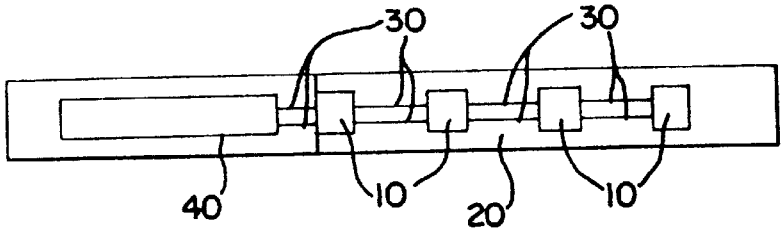
FIG. 8*a* is a side view of the device of FIG. 8 utilizing a plurality of LEDs.

FIG. 8 shows a hand held light signal using a single LED 10 embedded in the cover 20. The handle and cover 20 are generally cylindrical in shape and the size of a 2 cell flashlight, but the shape and dimensions may be varied to any convenient design The power source 40 is contained in the handle and the LED 10 is electrically connected by the conductors 30. A tube of retroreflective material 60, as described in U.S. patent application Ser. No. 08/802,526, may be placed over the cover to further enhance the transmission of light from the LED 10. A plurality of LEDs 10 can be contained within the cover 20 for the length of the cover 20 as shown in FIG. 8*a*.

Figure 9:
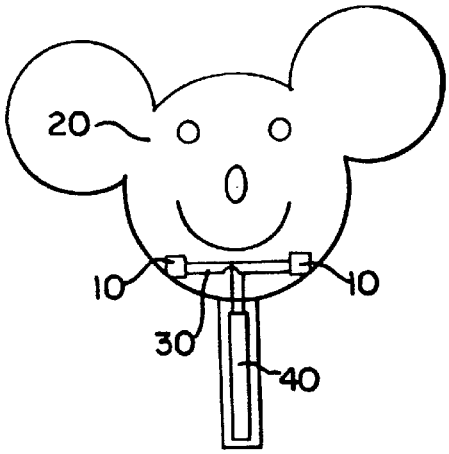
FIG. 9 is a front view of a shaped hand held light signal utilizing a plurality of LEDS embedded on a light modifying plastic cover.

FIG. 9 shows a shaped lighting device using a plurality of LEDs 10 within the cover 20.

Figure 10:
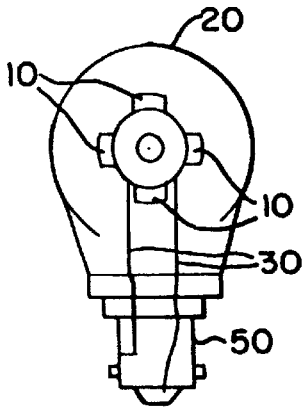
FIG. 10 is a side view of a LED bulb suitable to replace an incandescent bulb.

FIG. 10 shows a replacement bulb utilizing a plurality LEDs 10 as the light source instead of a filament. The cover 20 is attached to a base 50 as is commonly used for incandescent bulbs. The LEDs 10 are electrically connected to the base 50 by the conductors 30. The cover 20 is hollow and the LEDs 10 reside within the plenum defined by the surfaces of the cover 20. Tee number of LEDs 10 may be varied as dictated by the design.

Various features of the invention have been particularly shown and described in connection with the illustrated embodiments of the invention. However, it must be understood that these particular arrangements, and their method of manufacture, do not limit but merely illustrate, and that the invention is to be given its fullest interpretation within the terms of the appended claims.

I claim:

1. A lighting device comprising:

a power source electrically connected to a light source; and a light transmitting cover for the light source made from a polyolefin composed from a combination of ethylene/butene-1 copolymer and propylene homopolymer.

2. A lighting device comprising:

a power source electrically connected to a light source; and a light transmitting cover for the light source made from ethylene/butene-1 copolymer wherein the cover is clear.

3. A lighting device comprising:

a power source electrically connected to a light source; and a light transmitting cover for the light source made from a polyolefin from the group consisting of ethylene/butene-1 copolymer and propylene homopolymer, wherein the cover is additionally composed of a clarifying agent.

4. The lighting device of claim 3 wherein the clarifying agent is a sorbitol acetal in polyolefin blend.

5. A lighting device comprising:

a light source;

a cover for the light source made from a plastic composed from a combination of ethylene/butene-1 copolymer and propylene homopolymer;

a power source electrically connected to the light source; and an electronic circuit to cause the light source to flash when electrically connected to the power source and light source.

6. The lighting device of claim 5 wherein the light source is surrounded by the cover.

7. The lighting device of claim 5 wherein the light source is a semiconductor device.

8. The lighting device of claim 5 wherein the cover is in contact with the light source.

9. A lighting device comprising:

a base;

an LED;

a cover; composed of a polyolefin from the group consisting of ethylene/butene-1 copolymer and propylene homopolymer wherein said base is attached to said cover, forming a bulb, and said LED is electrically connected to said base and contained within the bulb.

10. The lighting device of claim 9 wherein the cover is composed of a polyolefin composed from a combination of ethlyene/butene-1 copolymer and propylene homopolymer.

11. The lighting device of claim 9 wherein the cover is clear.

12. The lighting device of claim 9 wherein the cover is additionally composed of a clarifying agent.

13. The lighting device of claim 12 wherein the clarifying agent is a sorbitol acetal in polyolefin blend.

14. A clear light transmitting material formed by heating a ethylene/butene material above 140 degrees F., and rapidly cooling said material by bathing the material in cold water.

15. The material in claim 14 wherein the water is approximately 34 degrees F.

16. A light transmitting material composed of a combination of an ethylene/butene-1 copolymer and a propylene homopolymer.

* * * * *